US006722975B2

(12) United States Patent
Duhamel

(10) Patent No.: US 6,722,975 B2
(45) **Date of Patent: *Apr. 20, 2004**

(54) METHOD OF AWARDING AN AUXILIARY GAME PRIZE ALONG WITH A POKER GAME

(75) Inventor: Gérald Duhamel, Drummondville (CA)

(73) Assignee: Labtronix Concept Inc., Drummondville (CA)

( * ) Notice: Subject to any disclaimer, the term of this patent is extended or adjusted under 35 U.S.C. 154(b) by 39 days.

This patent is subject to a terminal disclaimer.

(21) Appl. No.: 10/118,342

(22) Filed: Apr. 9, 2002

(65) Prior Publication Data

US 2002/0165018 A1 Nov. 7, 2002

Related U.S. Application Data

(63) Continuation-in-part of application No. 09/496,280, filed on Feb. 1, 2000, now Pat. No. 6,416,406.

(51) Int. Cl.[7] ..... A63F 1/00

(52) U.S. Cl. ..... 463/12; 463/20; 463/25; 273/274

(58) Field of Search ..... 463/11–14, 17, 463/20, 25; 273/138.1, 274, 139

(56) References Cited

U.S. PATENT DOCUMENTS

| | | | | |
|---|---|---|---|---|
| 5,393,057 A | | 2/1995 | Marnell, II | |
| 5,494,296 A | | 2/1996 | Grassa | |
| 5,570,885 A | | 11/1996 | Ornstein | |
| 5,586,766 A | | 12/1996 | Forte et al. | |
| 5,630,753 A | | 5/1997 | Fuchs | |
| 5,639,088 A | * | 6/1997 | Schneider et al. | 273/138.2 |
| 5,664,999 A | | 9/1997 | Kurihara | |
| 5,695,402 A | * | 12/1997 | Stupak | 273/138.2 |
| 5,743,800 A | | 4/1998 | Huard et al. | |
| 5,823,874 A | | 10/1998 | Adams | |
| 5,848,932 A | | 12/1998 | Adams | |
| 6,416,406 B1 | * | 7/2002 | Duhamel | 463/12 |

FOREIGN PATENT DOCUMENTS

| | | |
|---|---|---|
| DE | 198 12 491 A1 | 7/1999 |
| EP | 0 797 175 A1 | 9/1997 |
| EP | 0 971 326 A2 | 1/2000 |
| GB | 2 170 938 A | 8/1986 |
| GB | 2 270 005 A | 3/1994 |

* cited by examiner

*Primary Examiner*—Benjamin H. Layno
*Assistant Examiner*—Vishu Mendiratta
(74) *Attorney, Agent, or Firm*—Ogilvy Renault; James Anglehart

(57) ABSTRACT

A method for playing a poker game along with an auxiliary game, which depends on the poker game outcomes, is provided. The outcomes of the poker game are divided in three categories: credit events, no-credit events and non-event holds. Depending on their categories, outcomes influence the auxiliary game in different ways. The preferred way the auxiliary game works is by monitoring credit and no-credit events with a time window having neither a beginning nor an end; the amount of information monitored being constant. When a predetermined number of credits is accumulated within the monitoring window, an auxiliary prize is awarded. The invention also provides ways to display the information monitored by the auxiliary game so that this information is easy for players to understand and to follow. Accordingly, the invention provides an enhanced play experience that maintains excitement.

30 Claims, 10 Drawing Sheets

| Hand category | Prize value |
|---|---|
| No value | 0 time |
| Low pair from 2 to 9 | 0 time |
| High pair from Jack to Ace | 1 time |
| Two pairs | 2 times |
| Three of a kind | 3 times |
| Straight | 4 times |
| Flush | 5 times |
| Full house | 6 times |
| Four of a kind | 9 times |
| Straight Flush | 25 times |
| Royal Flush | 80 times |

Figure 3: Prize distribution schedule

| Hand category | Auxiliary game income value |
|---|---|
| No value | No-credit |
| Low pair from 2 to 9 | Non-event hold |
| High pair from Jack to Ace | Non-event hold |
| Two pairs | Non-event hold |
| Three of a kind | Credit |
| Straight | Credit |
| Flush | Credit |
| Full house | Credit |
| Four of a kind | Credit |
| Straight Flush | Credit |
| Royal Flush | Credit |

Figure 4: Auxiliary game evaluation schedule according to poker outcomes

| Row number | Number of credit present | Auxiliary prize |
|---|---|---|
| # 1 | 2 | 2 times |
| # 2 | 3 | 5 times |
| # 3 | 4 | 15 times |
| # 4 | 5 | 50 times |
| # 5 | 6 | Seed of 250 (progressive prize) |

Figure 5: Auxiliary prize distribution schedule

| Outcome number | Poker outcome | Outcome category | Auxiliary prize awarded |
|---|---|---|---|
| 1 | Three of a kind | Credit event | None |
| 2 | Two pairs | Non-event hold | None |
| 3 | Low pair (5's) | No-credit event | None |
| 4 | Straight flush | Credit event | 57 times |
| 5 | High Pair (Queen's) | Non-event hold | None |
| 6 | Low pair (3's) | Non-event hold | None |
| 7 | High Pair (Ace's) | Non-event hold | None |
| 8 | Three of a kind | Credit event | Progressive prize |
| 9 | Nothing | No-credit event | None |
| 10 | Straight | Credit event | 17 times |

Figure 6: Series of poker outcomes

Fig. 10

| | | | | | | | | | | | |
|---|---|---|---|---|---|---|---|---|---|---|---|
| * | * | | * | | | * | | | * | | |
| | | | | | | | | | | | |
| * | * | | | | | | | | | | |
| | | | | | | | | | | | |
| | | | | | | | | | | | |

Fig. 11

| | | | | | | | | | | | |
|---|---|---|---|---|---|---|---|---|---|---|---|
| | | | | | | | | | | | |
| * | | | | | | | | | | | |
| * | * | * | | | | | | | | | |
| * | | | | | | | | | | | |
| * | | | | | | | | | | | |

Fig. 12

| | | | | | | | | | | | |
|---|---|---|---|---|---|---|---|---|---|---|---|
| * | | | | | | | | | | | |
| * | | * | | | | | | | | | |
| | | | | | | | | | | | |
| * | | * | | | | | | | | | |
| | | | | | | | | | | | |

METHOD OF AWARDING AN AUXILIARY GAME PRIZE ALONG WITH A POKER GAME

RELATED APPLICATION

The present patent application is a continuation-in-part of Ser. No. 09/496,280 entitled "METHOD FOR PLAYING AN AUXILIARY GAME WITH PRIZE REWARDING SYSTEM", filed Feb. 1, 2000 now U.S. Pat. No. 6,416,406.

FIELD OF THE INVENTION

The present invention relates to an apparatus and a method for playing a poker game along with an auxiliary game. More particularly, the invention describes a method including steps of evaluating the outcomes of a poker game and using them as incoming information of an auxiliary game.

BACKGROUND OF THE INVENTION

In recent years, on numerous electronic gaming apparatus, various features such as bonus and auxiliary games have been developed. The goals of these features are: 1) to maintain players' interest and 2) to urge players to play for longer periods, therefore affecting the apparatus level of use and generating more revenues for its operators.

To achieve that goal, one known strategy consists in a progressive jackpot bearing a potential prize of much more impressive value than the others available prizes. Therefore, while playing, an increased of players' interest is caused by the possibility of winning this attractive jackpot. However, players have no urge to keep playing on the same apparatus. They can win the jackpot on any apparatus bearing this progressive jackpot, sometimes in more than one gaming facility.

Another strategy consists in the addition of a secondary game accessed via the occurrence of particular events during the playing of the primary game. These secondary games provide players with chances to increase their wins or to win special prizes, said special prizes being awarded only via the secondary game.

However, the excitement created via the secondary game does not last long. Furthermore, the excitement generated by the secondary game is not effective during the primary game play; players have no way to predict when a secondary game trigger is about to occur.

Jackpots and secondary game triggers are usually awarded according to single primary game outcomes. While playing the game, the player gets no hint that one jackpot or secondary game trigger is about to be yielded. Therefore, these games do not succeed to create prolonged periods of excitement.

A third strategy is the one described by Marnell in his U.S. Pat. No. 5,393,057. In the example, a bingo matrix display (the secondary game) is coupled to a poker game (the primary game). The occurrence of different outcomes in the poker game can yield modifications in the bingo matrix display. According to the standard rules of bingo, players win prizes in the auxiliary game when a predetermined pattern is present in the bingo display. An auxiliary game win requires winning while playing the poker game. Furthermore, it requires yielding predetermined poker hands to modify the bingo matrix accordingly. The downside of this method is that players do not feel the importance or the effect of each single play of the primary game on the auxiliary prize. However, they do feel the necessity to keep playing the game to avoid skipping over the outcome allowing them to win the auxiliary prize.

Another strategy available consists in progressive jackpots applied to live casino games played at tables. This solution has the same disadvantages as the above-mentioned strategies.

Yet another strategy is to monitor a number of predetermined outcomes in the primary game and to allow the player to access an auxiliary game when a predetermined number of these outcomes have occurred. Usually, this auxiliary game is a prize multiplier. Most of the time, the monitoring of these outcomes is neither available nor displayed to players; consequently players cannot foresee when they will access the auxiliary game. Often, they are not even aware of which outcomes are used to control access to the auxiliary game. However, even when the outcomes are known, players have no time limit to accumulate them, therefore no urge to play.

Another strategy is to give access to an auxiliary game wherein players gather points or the like, and are rewarded according to the number of points gathered. These points are both attributed and accumulated in the auxiliary game and are not a function of the primary game plays at all. The only link between the auxiliary game and the primary game consists in the trigger events of the primary game that control the access to the auxiliary game.

As a result, there have been no successful strategies developed to maintain players' interest throughout their participation in a game; none transmits to the players the conviction that each single play has its importance, without exception.

SUMMARY OF THE INVENTION

Accordingly, it is an object of the present invention to provide a method of playing an auxiliary game that maintains the interest of players over numerous plays of a poker game. Furthermore, it intends to increase the pleasure generated by the playing of the poker game. Another object of the invention is to provide a game wherein each playing of the primary game has its own importance. Another object is to provide an auxiliary game and a method of playing said auxiliary game creating an incentive for players to keep using the same gaming apparatus, therefore to play the same auxiliary game with the same game history. This in turn increases the profits generated by the apparatus.

It is also an object of the present invention to provide a method to allow the awarding of a progressive payoff, said progressive payoff having the effect of creating and maintaining additional interest. Another object is to display the information regarding the playing of the auxiliary game during the plays of the primary game to sustain players' excitement. A further object consists in concurrently monitoring multiple auxiliary game prizes, therefore allowing players to sustain suspense over the possibilities of winning multiple auxiliary game prizes at once. A further object of the invention consists in maintaining players' excitement by allowing them to gather whatever requirements to win prizes in the auxiliary game in a number of plays greater than the number of plays monitored by the auxiliary game. Players' chances of winning an auxiliary game prize are therefore increased.

According to the above objects, a method of playing an auxiliary game awarding prizes played along with a poker game is provided. The method comprises the following steps: 1) establishing a first class of poker outcomes and associating it with a first auxiliary income category labeled "credit events", 2) establishing a second class of outcomes and associating it with "no-credit events", 3) establishing a third class of outcomes and associating it with an auxiliary income category being "non-event holds", 4) monitoring credits over a predetermined number of said events, and 5) awarding a prize when a number of credits corresponding to a predetermined criteria is present in the auxiliary game. The above-mentioned method gives the players the advantage of avoiding no-credits with a series of non-event holds and credit events, as a result of prolonging suspense and increasing the players' chances of winning an auxiliary game prize.

Furthermore, the auxiliary game monitors auxiliary incomes over a predetermined number of credits. However, when the maximum number of credits available to be monitored is reached, the auxiliary monitoring system is not emptied; it always keeps track of the latest auxiliary incomes up to a maximum volume of information. Consequently, it creates a monitoring window "in time" following the poker plays. As a result, each auxiliary income affects more than one auxiliary game prize evaluation. Each single auxiliary income can have a determinant influence on multiple potential prizes within the auxiliary game regardless of the moment of the auxiliary income entry.

A preferred embodiment of this invention comprises an electronic gaming apparatus in which a poker game is linked to an auxiliary game monitoring system operating according to the method described above. The information monitored by the auxiliary game is displayed in the upper section of the electronic display. Below are the cards allowing the playing of the poker game. This information is easy to read and easily understood by any players, novices as well as experts. In this embodiment, an outcome evaluated as higher than two pairs is a credit event, a loss is a no-credit event, and a poker outcome evaluated as a pair or two pairs, whether or not it has a poker play value, is a non-event hold in the auxiliary game. A monitoring matrix keeps track of credits and no-credits on the screen. At least one progressive prize associated with the matrix display is available according to credit-based criteria. To play the auxiliary game, players must place a flat additional bet (a.k.a. side bet), said flat additional bet being the same from play to play and independent of the poker game bet.

Another embodiment is provided in which the auxiliary game is played in association with a poker game wherein no outcomes are evaluated as non-event holds. Therefore, all poker outcomes generate an input in the auxiliary game. Consequently, the evaluation of an auxiliary prize cannot be done over more poker outcomes than the auxiliary input monitored. Furthermore, a mystery auxiliary prize is awarded to players who succeed in yielding an auxiliary game matrix bearing information that corresponds to mystery criteria.

A third embodiment of the invention consists in an auxiliary game following the same rules of evaluation of poker plays as the above described first embodiment. However, the monitoring of events by the auxiliary game monitoring system and the criteria used to determine credits, no-credits and holds are different. The auxiliary game monitoring system keeps track of the credit events provided by the poker game until a no-credit event occurs. This no-credit event has the effect of clearing away every current credit. However, non-event holds have no effect on the monitoring matrix. Consequently, the number of plays required to win a prize depends on the number of non-event holds occurring.

BRIEF DESCRIPTION OF THE DRAWINGS

These and other features, aspects and advantages of the present invention will become clearer after examination of the following description and accompanying drawings, wherein:

FIG. 3 is the prize distribution used along with the example of the first embodiment;

FIG. 4 is the auxiliary game evaluation schedule of the example;

FIG. 5 is the auxiliary prize distribution schedule of the example;

FIG. 6 is the series of poker outcomes used for the example;

FIG. 10 is the matrix display of FIG. 9, later during the play session;

FIG. 11 is the matrix display of FIG. 10, later during the play session;

FIG. 12 is the matrix display of FIG. 11 at the end of the play session of the example;

DETAILED DESCRIPTION OF THE PREFERRED EMBODIMENTS

Figure 1:
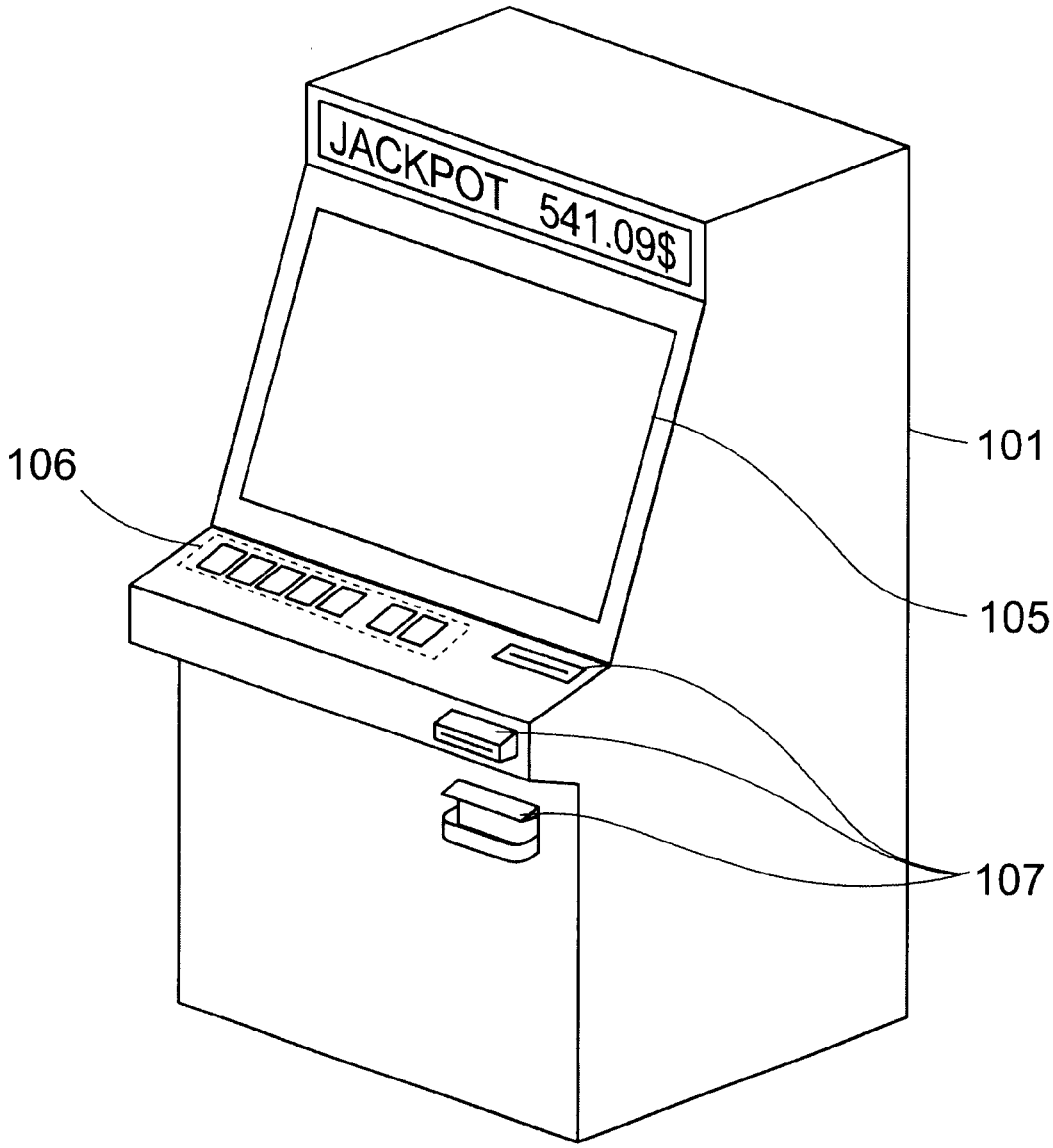
FIG. 1 is a perspective view of an electronic gaming apparatus built in accordance with the present invention.

FIG. 1 presents an electronic gaming apparatus 101 for the playing of an electronic game such as a poker game along with an auxiliary game. The electronic gaming apparatus 101 comprises controls 106 for the playing of the poker game, money input/output system 107 embodied differently according to whether or not the apparatus allows cashless transactions, and an electronic display 105. The electronic gaming apparatus 101 can comprise more devices in accordance with the requirements of the facility wherein the apparatus is installed. However, the systems 105, 106 and 107 are the essential ones required for the playing of a poker game in accordance with the present invention.

Figure 2:
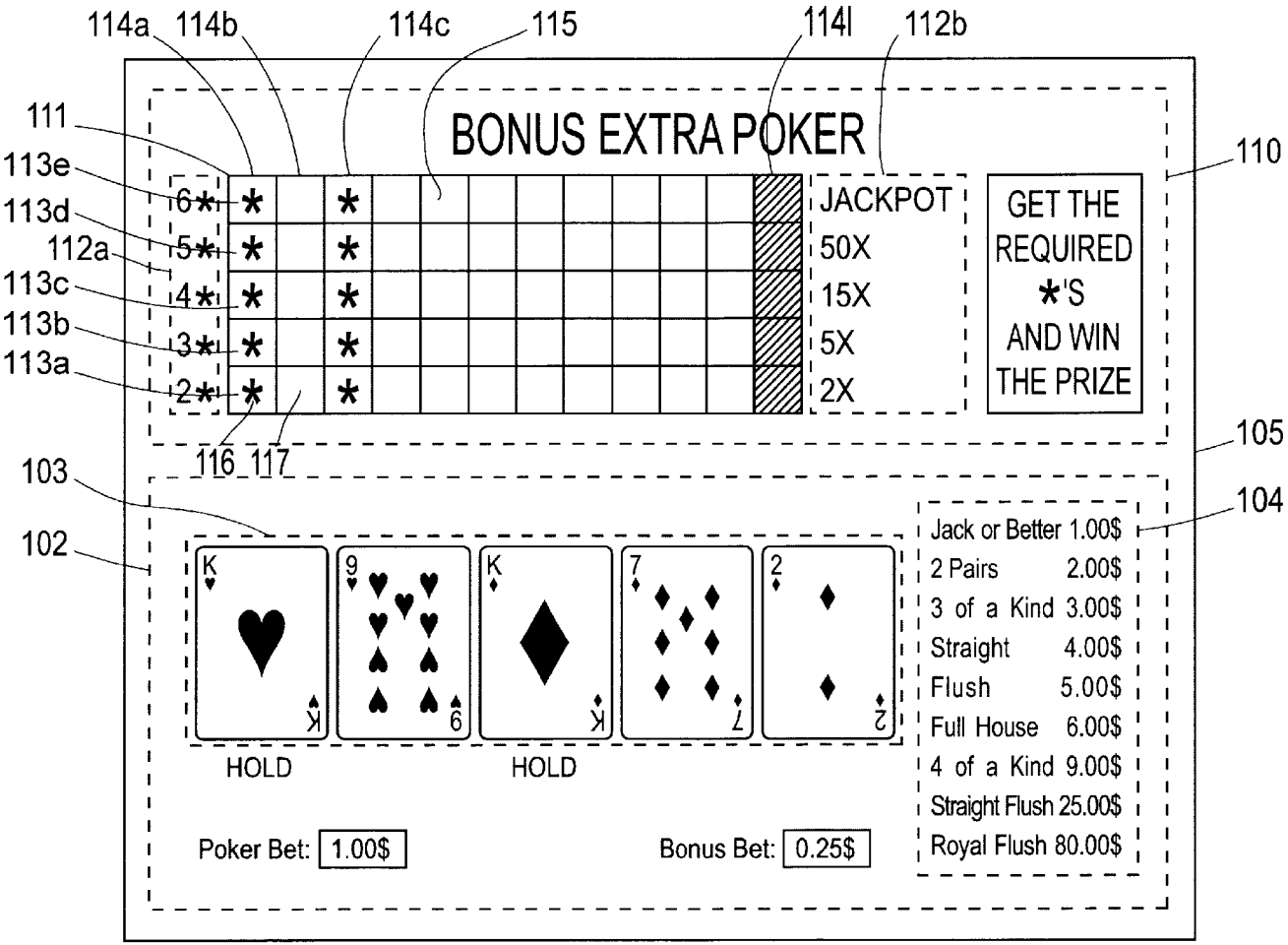
FIG. 2 is a schematic representation of the playing screen of the electronic gaming apparatus shown in FIG. 1.

FIG. 2 shows the typical play screen of an electronic gaming apparatus 101 comprising a poker game along with an auxiliary game. The lower section 102 of the screen shows cards 103 used to yield poker hands and poker related information 104, while the upper section 110 presents the monitoring matrix 111 and auxiliary game related information 112*a* and 112*b*.

First Embodiment

A closer look at the auxiliary game section of the play screen 105, FIG. 2, reveals the monitoring matrix 111 composed of numerous horizontal rows 113*a–e* and numerous vertical columns 114*a–l*, the whole composing a matrix of cells 115. Each matrix cell 115 is used to keep track of incoming information, said information is used afterwards to evaluate whether an auxiliary prize has to be awarded. Each column 114 bears the information corresponding to one poker play. Each row 113 has its own criteria 112*a* regarding the awarding of an auxiliary prize and its own auxiliary prize value 112*b*. As the poker game progresses, the poker outcomes 103 are evaluated and processed as incoming auxiliary game information, which is entered in the monitoring matrix 111. When new information enters the monitoring matrix 111, the current information is scrolled one column to the right and the far right column 114*l* information is discarded to make room for new information on the left. This way, the amount of information monitored by the monitoring matrix 111 is constant at every play.

The information monitored falls into two categories: credits and no-credits. However, the poker outcomes 103 are evaluated to generate three (3) categories: credit events, no-credit events and non-event holds. Credit events occurring in the poker game have positive effects on the auxiliary game. No-credit events occurring have negative effects. However, non-event holds have no effect on the auxiliary game. Therefore, yielding a non-event hold during one poker play does not influence the auxiliary game; it is just as if no poker play has been played from the auxiliary game perspective.

The credits are displayed as asterisks 116 in the monitoring matrix 111 while no-credits are displayed as empty cells 117. In connection with the playing of the poker game, credits 116 are entered in each cell of the first column 114*a*. When a no-credit event occurs in the poker game, all of the credits present in the monitoring matrix 111 scroll one column to the right while the far left column 114*a* stays empty. After each entry of information in the monitoring matrix 111, an evaluation is made in regard to auxiliary prizes available to be awarded. When one auxiliary prize is awarded, the credits participating in that prize are replaced by no-credits. This way, only the information regarding credits that can participate in awarding an auxiliary prize is present in the monitoring matrix 111.

The method and first embodiment of the present invention will be more readily understood by reference to the following example. However, this example is presented to illustrate the embodiment rather than to limit the scope of the invention.

EXAMPLE

Please note that the sequence of outcomes of the following example is presented for explicative purpose only. The example information is chosen regardless of the probability of occurrence of each of the poker outcomes, only to clearly illustrate each step of the method. As a result, the method will be more easily reproduced.

First of all, the auxiliary game of this embodiment consists in a side bet type of game. In other words, to participate in the auxiliary game, players must place an additional bet. This bet is used to provide money to award the auxiliary prize, while said prize is determined according to the side bet regardless of the bet placed on the poker game. Furthermore, the side bet always has the same value regardless of the bet value of the poker game. Moreover, the side bet is constant through all plays of the poker game. Players have only two side bet options: whether or not to place one. According to the side bet being placed, the poker outcome is evaluated at the end of the play and new information is entered in the monitoring matrix. If there is no side bet, the poker outcome is not evaluated in regard to the category it would have been and used as. However, even with a side bet, if the poker outcome is a non-event hold, no new information takes part in the auxiliary game. Consequently, obtaining non-event holds allows players to increase the number of plays in which a particular credit can be effective in the auxiliary game.

To start a play session, the player first inserts coins, a smart card or whatever monetary value used in the gaming facility. From then on, these coins constitute the player account from which is decreased each bet placed on the poker game and the auxiliary game. Each time a bet is placed, the player account is withdrawn from the same value. Each time the player wins, the prize value is added to the account. When the player ends it play session, he cashes out the entire account, which increases the smart card value or is delivered through a coin drop for example.

Figure 7:
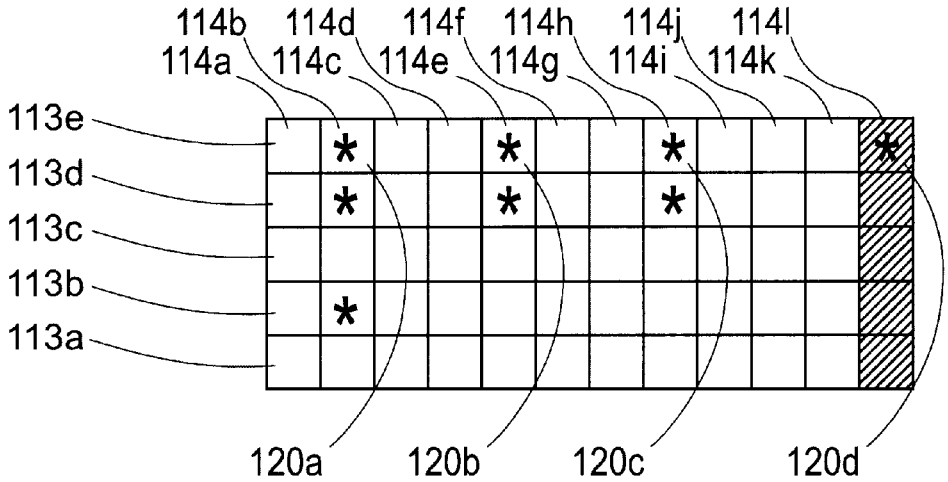
FIG. 7 is a closer look at the monitoring matrix display of the auxiliary game shown in FIG. 2 at the beginning of the play session of the example.

As an example, the monitoring matrix of FIG. 7 is displayed at it appears when the player comes to at the electronic gaming apparatus. The player inserts enough money in the apparatus for his whole play session. He can place a bet of one (1) to ten (10) coins on the poker game and a fixed side bet of one (1) coin. Regardless of the bet placed on each play, when there is at least a one-coin bet on the poker game, the player can start his play by pressing the PLAY button. Afterwards, five (5) cards are drawn from a virtual card deck and displayed on the screen. The player chooses which cards to hold; new ones drawn from the card deck replace the others. Once completed, the poker hand constitutes the final outcome of the poker play, which is evaluated. The player is awarded a poker prize according to the evaluation, the poker game prize distribution schedule, and the bet.

If the player has placed a side bet, the poker hand is also evaluated to determine its category. If the poker outcome is a credit or a no-credit event, the monitoring matrix is updated. However, if the poker outcome is a non-event hold, the monitoring matrix stays the same.

FIG. 3 presents the prize distribution schedule of the poker game while FIG. 4 presents the category evaluation criteria. Even if both are evaluation according to standard poker categories, the used criteria are not the same. Furthermore, the evaluation to determine whether a poker outcome has a positive effect on the auxiliary game is totally independent from the value of the poker outcome in the poker game. A "low pair" has no value in the poker game (FIG. 3); however it generates no negative effect on the auxiliary game (non-event hold, FIG. 4). The same way, poker hands evaluated as "high pair" and "two pairs" hands have a positive value that allows a poker prize to be awarded. Nevertheless, poker hands evaluated as "three of a kind" or higher are required to obtain a true positive effect on the auxiliary game.

The auxiliary prizes available are independent from row to row in the monitoring matrix. Each time a new entry is included in the matrix, each row is evaluated according to the current number of credits in the row cells versus the criteria for awarding an auxiliary prize for that row. Therefore, players can win multiple auxiliary prizes with the addition of new credits in the matrix. FIG. 5 lists the different requirements regarding numbers of credits for the different rows. Furthermore, FIG. 5 lists the auxiliary prize values. It is interesting to note that the highest one is a progressive prize. As a result, each time a side bet is placed, a predetermined percentage of the side bet increases the value of this progressive prize. According to the operator preference and the apparatus configuration, the progressive prize can be independent on each apparatus or shared by a bank of linked apparatus. With a shared progressive prize, the prize increases faster but is also won faster because of the increased number of apparatus having chances to win it at each play.

Once the poker game distribution schedule, the auxiliary game category evaluation schedule and the auxiliary prize distribution schedule are determined, the example can really begin with a series of poker outcomes. The player places bets (poker and auxiliary game bets) at the start of each play. As stated above, the apparatus bears an auxiliary game history (monitoring matrix information) as illustrated in the FIG. 7. As the play session progresses, the information born by the monitoring matrix is modified.

FIG. 6 lists the series of poker outcomes and the corresponding auxiliary game entries used in the example. Furthermore, FIG. 6 lists the auxiliary prizes awarded as the poker game is played(shown as numbers of times the side bet value). In the example, the series of poker outcomes are evaluated while annexed figures state the information currently contained in the monitoring matrix.

When the play session begins, FIG. 7, no auxiliary prize is ready to be awarded. Consequently, each row 113 of the monitoring matrix 111 bears a number of credits lower than its criteria. Per example, the top row 113*e* bears four (4) asterisks 120*a–d* while the criteria associated with this row is to bear six (6) asterisks. Consequently, only two (2) new asterisks are required. However, upon entering new credits in the monitoring matrix, the player sees the credits scrolling to the right and disappearing.

Figure 8:
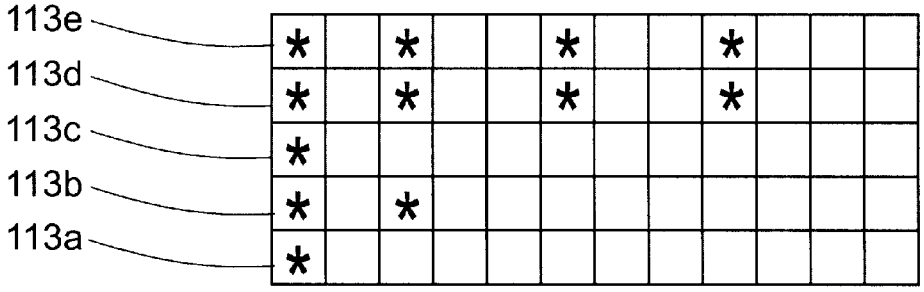
FIG. 8 is the matrix display of FIG. 7, later during the play session.

The first poker play yields a "three ok a kind" category of outcome. As a result, the player is awarded three (3) times his poker bet. Because he also placed a side bet, the player is awarded credits. These credits are entered on the far left of the monitoring matrix by scrolling while the current information scrolls to the right. Entering the player new credits creates a new matrix as illustrated in FIG. 8. Since no auxiliary game criteria are met, no auxiliary prizes are awarded.

The second poker outcome is "two pairs". It allows the player to be awarded a poker game prize. However, since this outcome is evaluated as a non-event hold, it does not affect the information in the monitoring matrix. After the second poker outcome, the monitoring matrix bears the same credits as illustrated in FIG. 8. Obtaining an outcome that does not affect the matrix information has a positive effect on the auxiliary game; it allows yielding the required number of credits with a greater number of poker outcomes. The third poker outcome is also evaluated as a non-event hold. Regardless of the fact that this poker outcome amounts to a loss in the poker game, obtaining this kind of outcome has a positive effect on the auxiliary game. Consequently, the auxiliary game depends on the poker game for its play but is independent of the poker outcome value.

Figure 9:
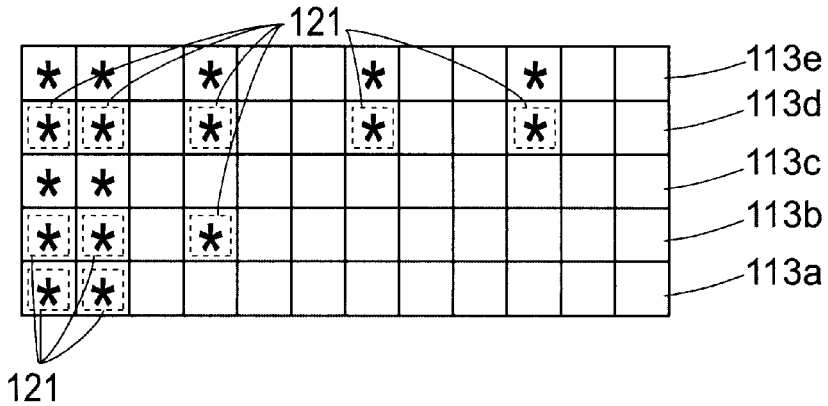
FIG. 9 is the matrix display of FIG. 8, later during the play session.

The fourth outcome is a "straight flush", therefore entering credits in the monitoring matrix. A new monitoring matrix is yielded, see FIG. 9. According to criteria listed in FIG. 5, auxiliary prize are to be awarded. The rows 113*a*–113*b* and 113*d* bear numbers of credits matching their criteria. The asterisks surrounded by hatched lines 121 illustrate credits participating in the awarding of an auxiliary prize, as illustrated in FIG. 9. Since three (3) criteria are met, an auxiliary prize having a value of fifty-seven (57) times the side bet is awarded. This number sums up the three (3) prizes awarded. Once awarded, the participating credits 121 are removed from the matrix. The new matrix is illustrated in FIG. 10. It is now easily understandable why, even with credits entered in every cell of a column 114, credits are sometimes displayed alone or as small numbers in some columns 114; the empty cells 117 are credits that already participated in awarding a prize.

The following outcomes (the fifth, sixth and seventh) do not influence the matrix. The eight forces the entry of credits in the matrix. It yields the matrix illustrated in FIG. 11 once the intermediary display stating which credits participate in the next prize has ended. The new prize awarded is not two hundred and fifty (250) times the side bet. It is a progressive prize. With each side bet placed, the progressive prize grew from a seed value to its current value. The prize awarded is determined when the matrix bears the required number of credits on the top prize row 113*a*. Once awarded, the prize goes back to its seed value. Afterwards, it grows back as side bets are placed.

The last two (2) outcomes yield a monitoring matrix bearing new information. FIG. 12 illustrates the awarding of auxiliary prizes. Once again, more than one (1) criteria is met with one (1) entry of credits in the matrix.

It is interesting to note that, independently from the number of poker outcomes yielded, the original information born by the matrix scrolled six (6) columns to the right. However, the number of side bet placed is ten (10). This is advantageous for both players and operators. Operators see more money participating in the side bet (ten (10) coins) and less possibility of winning a side bet prize (six (6) entries in the matrix). Players have more poker plays to yield the required number of credits without seeing useful credits being dropped out the matrix.

Figure 13:
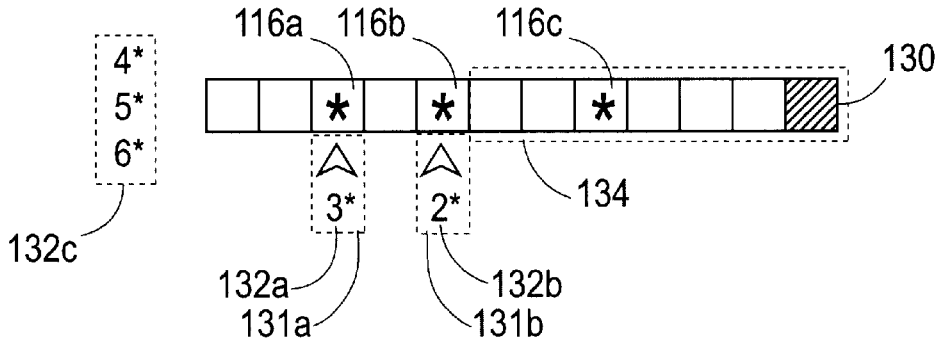
FIG. 13 is a schematic representation of an alternative monitoring tool for the playing of the auxiliary game.
Figure 14:
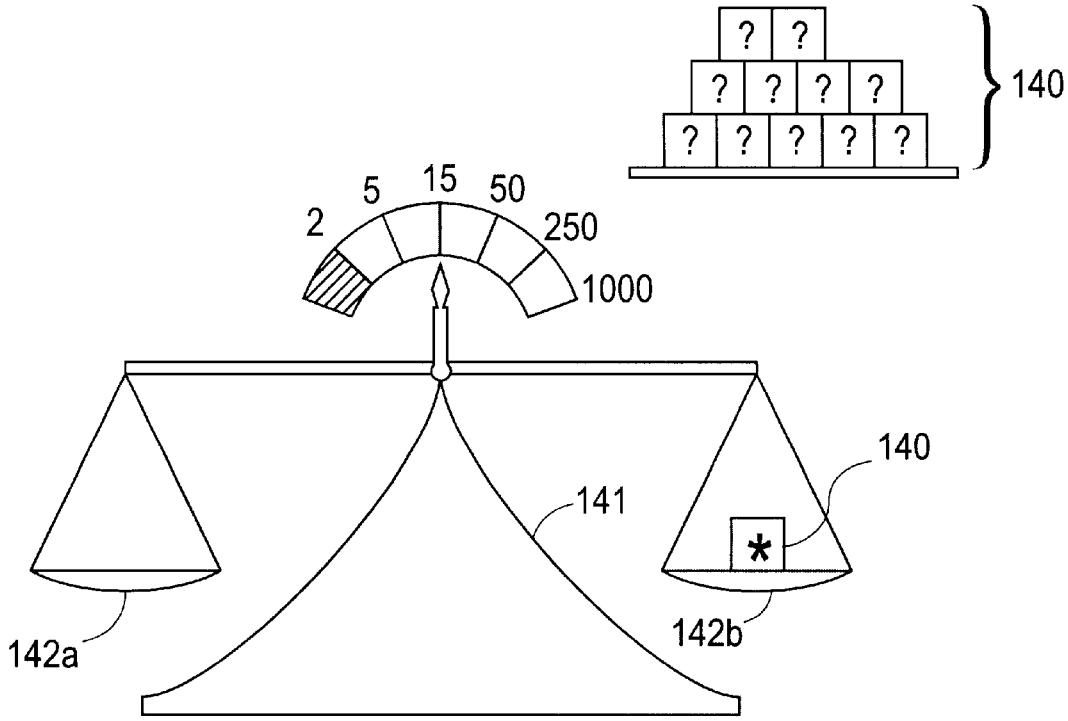
FIG. 14 is a schematic representation of another alternative monitoring tool according to the method of the present invention.

FIG. 13 and FIG. 14 illustrate other ways to state the credits monitored by the auxiliary game. FIG. 13 illustrates a single row 130 bearing credits 116. Associated with some of these credits 116*a*–116*b* is the last time they participated in a prize awarding and the criteria. It allows a more compact display of the auxiliary game. Furthermore, calculating the number of credits required remaining to be awarded an auxiliary prize is easy. When credits participate in awarding a prize, the credit being the last entered 116*a*–116*b* become associated with an informative tag 131*a–b*. This tag 131*a–b* bears the criteria 132 met. Therefore, players know their needs regarding an accumulation of credits within the cells 133 on the left of the tag 131*a* as example; cells on the right of it 134 are not effective for any new awarding according to this criteria 132*a*. FIG. 14 illustrates a more visual way to inform payers. Players have a predetermined number 140 of credits and no-credits to place on a platform scale 141. However, the number of outcomes needed to complete it is undetermined. For each poker outcome, the outcome is evaluated and a weight is placed on a platform 142*a–b* according to the outcome evaluation. If the outcome is a non-event hold, no new weights are placed. When all weights are on the platforms 142, the player is awarded according to the scale reading 143. As a result, the last option offers a known beginning to the auxiliary game accumulation of credits. However, the end is unknown; it depends on the number of non-event holds.

Second Embodiment

This embodiment consists in the use of only two (2) categories of outcomes: credits and no-credits events. With this embodiment, the same kind of monitoring matrix 111 can bear credits as the play progresses. Three (3) major differences exist between this embodiment and the first. 1) For the auxiliary game, Poker outcomes are evaluated independently from their poker value. 2) There is no need of side bet; the auxiliary prizes available are determined in regard to the level of play of the poker game. 3) The auxiliary game bears a mystery prize.

As stated above, the poker outcomes are evaluated according to only two (2) categories; the non-event hold category does not exist. When a final outcome yielded contains a particular card or a particular number of cards from a predetermined set, it corresponds to an entry of credits in the matrix. However, when this criteria is not met, no-credits are entered in the matrix. An example of a criteria is to obtain a final hand bearing at least an ace. Like stated above, it is totally independent from the poker evaluation. Moreover, the embodiment can change the player strategy according to the credits born by the matrix and the initial poker hand. As a result, it creates a new challenge for players, a new dynamic of play.

Only one bet is required for this embodiment. According to the bet placed, the range of the auxiliary prizes available varies from none to all according to the bet value. As an example, if the player bets two (2) coins, only the high row 113*e* prize is available. If the bet is four (4) coins, the top three (3) row 113*c–e* prizes are available. And it gradually changes along with the bet level, with a maximum bet offering all of the auxiliary prizes. This way, the total payout of the game increases along with the bet level. Furthermore, the contribution to the payout of an auxiliary prize decreases as the bet increases. The top row 113*e* auxiliary prize contributes to half with a bet of four (4) coins than what it contributes with a two (2)-coin bet. For the same prize awarded, there is two (2) times the amount incoming when playing at four (4) than two (2) coins. Consequently, it is possible to create an interesting gradation of the payout versus the bet with this method. To avoid players increasing their bets only at favorable times according to matrix information, entries are operated only on rows bearing available prizes. As a result, credits are only entered on the top row 113*e* when players bet two (2) coins; the other cells of the same column 114*a* stay empty.

Figure 15:
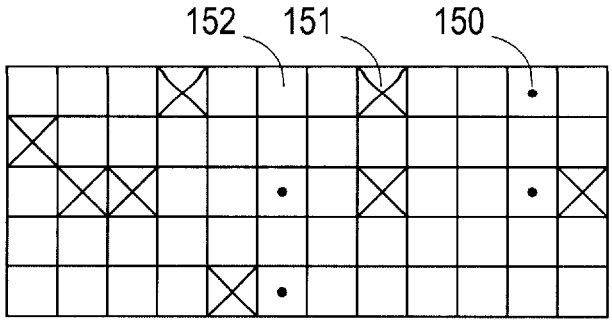
FIG. 15 is the matrix display pattern used as mystery prize criteria.
Figure 16:
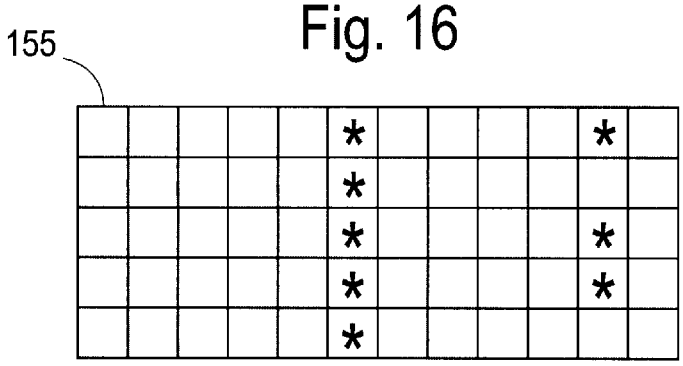
FIG. 16 is an example of matrix matching the matrix display pattern of FIG. 15.

When playing at maximum bet, the player who yields a matrix bearing a predetermined shape is awarded a mystery prize. FIG. 15 illustrates this principle. In that example, cells bearing a dot 150 are the ones requiring credits. Cells bearing an X 151 require the absence of credits. Cells without any particular signs 152 are not evaluated. To be awarded the mystery prize, a player must place a maximum bet and have a matrix bearing the same pattern regardless of the non-evaluated cells 152. FIG. 16 illustrates a matrix matching this criteria. With the mystery prize, players can win an auxiliary prize with a last entry of no-credits 155. The matrix of FIG. 16 illustrates a situation when a player succeeded to match the above criteria with a last entry of no-credits. If the last entry were an entry of credits, the pattern would not have been matched.

Third Embodiment

The third embodiment used the same poker outcome categories as the first embodiment. The monitoring means consists in a stair-like matrix wherein for each row a maximum number of credits is possible to accumulate. Once the maximum number of credits is accumulated on a row, the prize associated to that row is awarded. The credits of that row are cleared away. According to the number of credits required, the prizes differ from on row to another. The row requiring the maximum number of credits is associated to the highest prize. To accumulate credits, a credit outcome must be yielded. Non-event holds do not influence the matrix information, while a no-credit event clears away the whole information born by the matrix.

Figure 17:
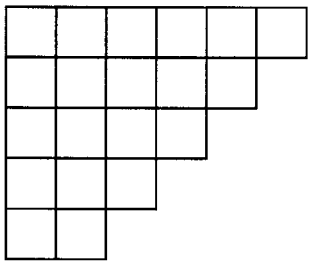
FIG. 17 is a matrix display according to the third embodiment.
Figure 18:
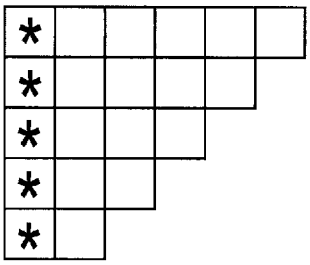
FIG. 18 is the matrix display of FIG. 17, later during the play session.
Figure 19:
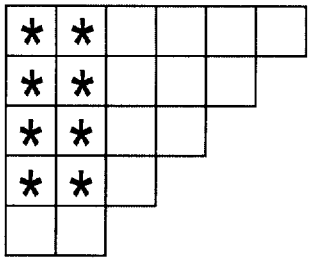
FIG. 19 is the matrix display of FIG. 18, later during the play session.

FIG. 17 presents the monitoring matrix as used with this embodiment. At the beginning of the play session, the monitoring matrix is empty. To show an example of how this embodiment is played, the use of the series of poker outcomes of FIG. 6 is required. After the first outcome, a credit is added to the monitoring matrix. It yields a new matrix illustrated in FIG. 18. The second outcome does not change the monitoring matrix since it is a non-event hold. The third outcome is a no-credit event; it clears away the credits accumulated in the matrix yielding the one illustrated in FIG. 17. The fourth to the eighth outcomes yield back the matrix of FIG. 18. In the case of the next outcome being a credit event, it yields a new monitoring matrix bearing credits as illustrated in FIG. 19. As a result of no no-credit event being monitored since the last credit event, two credits are accumulated on each row. The lowest row of the matrix is composed of only two cells. Consequently, the prize corresponding to that row is awarded and the credits of that row are cleared away. However, since the maximum number of credits is not reached on the other rows, these credits are still present. A new credit can be monitored to pay a new prize if no no-credit event occurs before.

Figure 20:
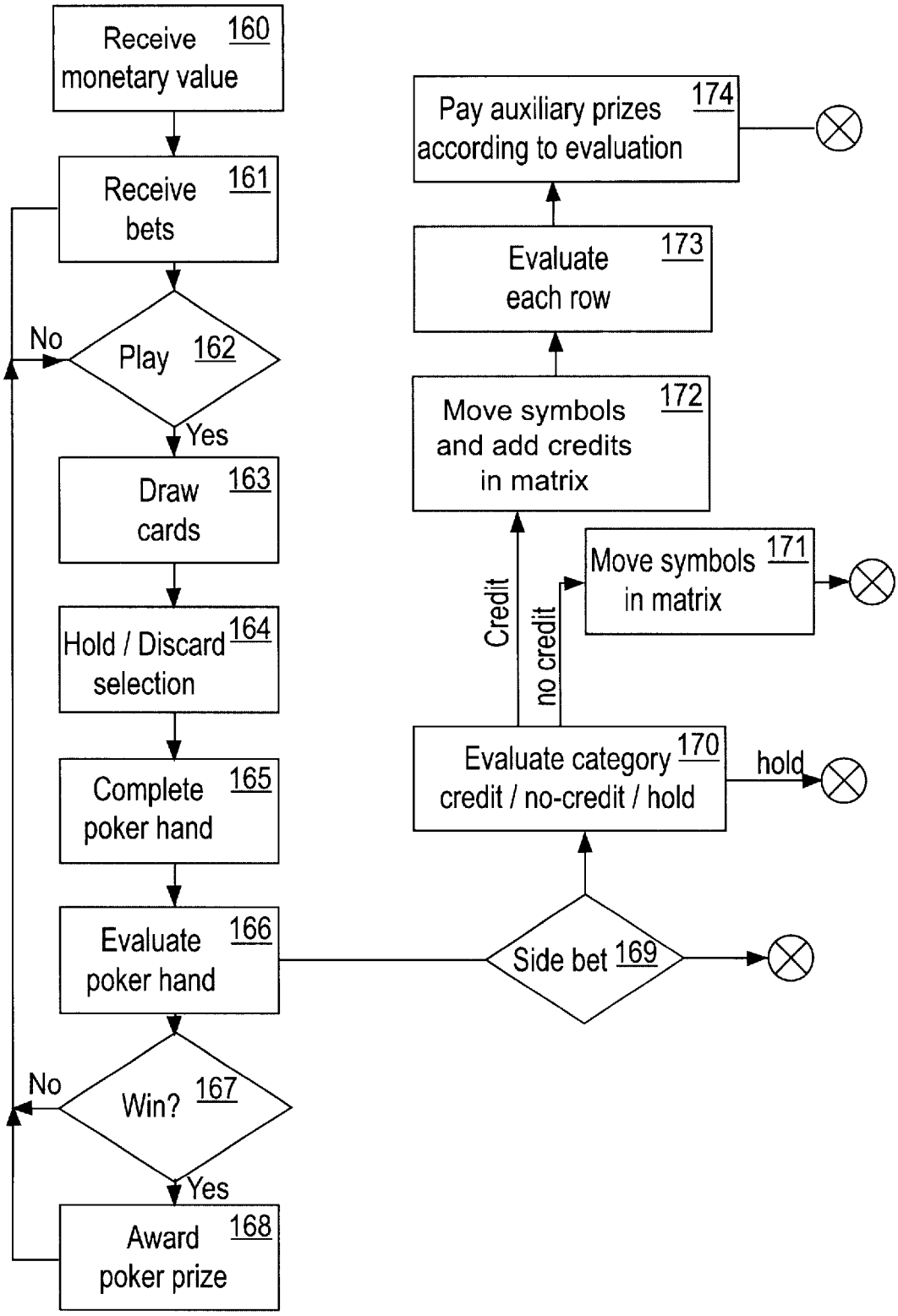
FIG. 20 is a flow chart illustrating the steps performed by the gaming apparatus during a poker play according to a preferred embodiment.

FIG. 20 states the standard steps for playing of a poker game along with an auxiliary game on an electronic gaming apparatus. The steps are described for the first embodiment. Even if the steps are not exactly the same for the other embodiments, the general steps are the same for all embodiments of the present invention.

First, the gaming apparatus receives money values 160 from the player, said money values are further used for betting. Bets are placed 161 according to player selections. When the bets are placed, the player actuates a control to start the play 162. Five cards are drawn 163 from a card deck and displayed on the screen. At this time, the player can select 164 which card to hold and which card to discard. Once the selection is completed, the player actuates the play control again to continue the play. Cards are drawn 165 and displayed to replace the discarded cards. Afterwards, the gaming apparatus evaluates the poker outcome 166 to determine if the player is awarded a prize. According to the result of the evaluation 167, a prize is either awarded 168 or not.

Once the poker play is completed, the gaming apparatus verifies the presence of an auxiliary bet 169. In case no auxiliary bet is placed, it stops there. If a bet has been placed, an evaluation of the poker outcome 170 is operated according to the auxiliary game evaluation criteria. If it is a non-event hold, nothing happens. If it is a no-credit event, the monitoring matrix is updated 171 by a modification of the credit positions. If the outcome is a credit event, the current credits in the monitoring matrix are moved one space to the right to free space for new credits 172. Afterwards, the matrix is evaluated 173 to determine if it bears the number of credits required on one row to award a prize. Accordingly, auxiliary prizes are awarded 174. When all these steps are done, a new play may begin.

Figure 21:
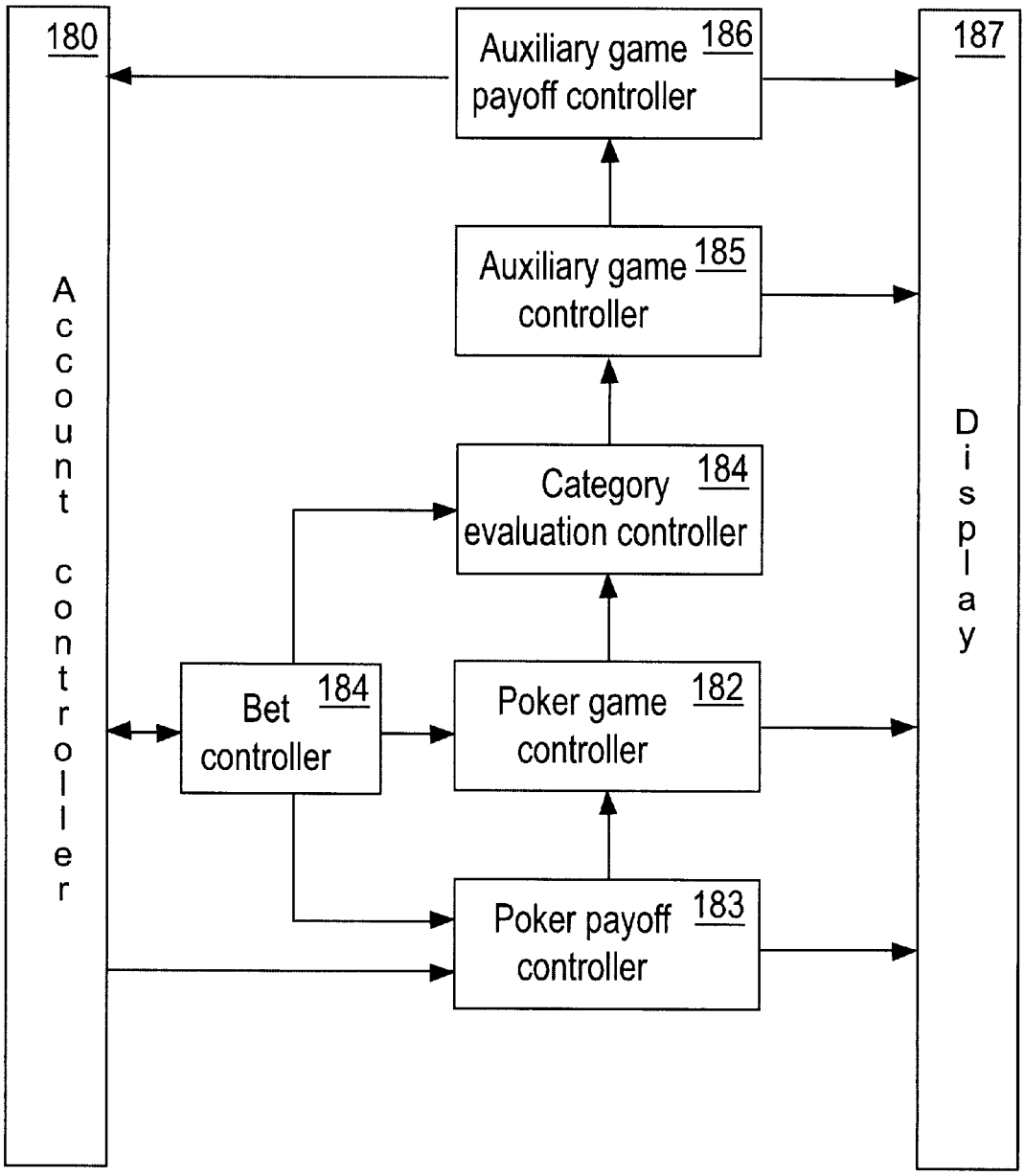
FIG. 21 is a block diagram illustrating the preferred embodiment essential components.

FIG. 21 is a block diagram of the components participating in poker plays and the auxiliary game. When starting the game, the bet controller 181 receives a bet selection from the player. According to the account controller 180, the bet value is limited to a different value. As the bets being placed, the account controller 180 modifies the account value. Afterwards, the play can begin. The poker controller 182 signals to the display 187 the card to show, to hold, and to discard. When the poker play is complete, a signal corresponding to the poker outcome is sent to the poker payoff controller 183 and the class evaluation controller 184. The poker payoff controller 183 evaluates the outcome and signals to the account controller 180 the amount awarded according to information coming from the bet controller 181. At the same time, the display 187 receives information regarding the win value to display on the screen. Concurrently, the category evaluation controller 184 determines the category of the poker outcome according to the bet controller 181 signaling whether or not an auxiliary bet is placed. The category evaluated determines whether or not the auxiliary game controller 185 updates the monitoring matrix and the displayed matrix. As with the poker outcome, the auxiliary game payoff controller 186 evaluates if an auxiliary prize has to be awarded. It signals the auxiliary prize to both display 187 and account controller 180 to update information.

While the invention has been described in connection with specific embodiments thereof, it will be understood that it is capable of further modifications and this application is intended to cover any variations, uses, or adaptations of the invention following, in general, the principles of the invention and including such departures from the present disclosure as come within known or customary practice within the art to which the invention pertains and as may be applied to the essential features herein before set forth, and follows in the scope of the appended claims.

What is claimed is:

1. A method of processing principal game outcomes in order to determine a prize in an auxiliary game played along with a principal game, the method comprising the steps of:

establishing a first class of outcomes in said principal game associated with a no-credit event in said auxiliary game;

establishing a second class of outcomes in said principal game associated with a credit event in said auxiliary game;

establishing a third class of outcomes in said principal game associated with a non-event hold;

monitoring credit events and no-credit events in said auxiliary game with said no-credit events erasing all of current credit events monitored; and signaling that a prize in said auxiliary game is to be awarded when a predetermined number of credits are monitored.

2. The method of claim 1, wherein:

said principal game is a poker game;

a credit criterion is defined as the occurrence of a poker hand of at least a predetermined credit value according to the poker rules;

a non-event hold criterion is defined as the occurrence of a poker hand of at least a predetermined hold value lower than said credit value according to the poker rules; and a no-credit criterion is defined as any poker hand having failing to match said credit and said hold criterion.

3. The method of claim 1 wherein:

said principal game is a poker game;

a credit criterion is defined as the occurrence of a poker hand bearing at least one card from a predetermined first set of cards;

a non-event hold criterion is defined as the occurrence of a poker hand bearing no card for said first set and bearing at least one card from a predetermined second set of cards; and a no-credit criterion is defined as any poker hand failing to match said credit and said hold criterion.

4. The method of claim 1, wherein said step of signaling comprises evaluating said number of credits independently of an order or a sequence thereof.

5. The method of claim 1, wherein a bet is required for the completion of said step of monitoring events in said auxiliary game.

6. The method of claim 1, further comprising the step of displaying information regarding credits obtained in a predetermined number of past events.

7. The method of claim 6, wherein said step of displaying information further comprises the step of displaying information regarding prizes awarded.

8. The method of claim 6, wherein said step of displaying information is accomplished by:

displaying a matrix-like display;

filling up a row or column of said matrix-like display each time a new said credit event occurs in said principal game with symbols corresponding to said credit events; and erasing all of said symbols in said matrix-like display with the occurrence of a new said no-credit event in said principal game.

9. The method of claim 8, wherein said step of filling up said matrix-like display further comprises erasing or replacing credit symbols participating in the awarding of an auxiliary prize.

10. The method of claim 8, wherein each said row or said column is used to monitor a different number of said credit symbols and each said row or said column is associated with a prize.

11. The method of claim 10, wherein each said row or said column associated with a prize contains a number of cells equal to the number of said credit symbols required to award a prize on said row or said column.

12. The method of claim 10, wherein said matrix-like display concurrently monitors at least three (3) said auxiliary prizes.

13. A gaming apparatus including an auxiliary component, said apparatus comprising:

a principal game controller generating a signal representing principal game outcomes in a principal game;

a class determination means for interpreting a principal game outcome and generating a class signal, said class signal corresponding to a credit event, a no-credit event, or a non-event hold;

a monitoring means for keeping track of credit events while the occurrence of no-credit events resetting the monitoring means;

a payoff means for awarding a prize when a predetermined number of credits are monitored; and a display.

14. A method of processing principal game outcomes in order to determine a prize in an auxiliary game played along with a principal game, the method comprising the steps of:

establishing a first class of outcomes in said principal game associated with no-credit events in said auxiliary game;

establishing a second class of outcomes in said principal game associated with credit events in said auxiliary game;

establishing a third class of outcomes in said principal game associated with non-event holds;

monitoring credit events and no-credit events in said auxiliary game over a predetermined number of past events in said auxiliary game with non-event holds increasing the number of principal game outcomes required for an event to stop being monitored; and signaling that a prize in said auxiliary game is to be awarded when a predetermined number of credits is present in said predetermined number of past events in said auxiliary game.

15. The method of claim 14, wherein:

said principal game is a poker game having poker rides;

a credit criterion is defined as the occurrence of a poker hand of at least a predetermined credit value according to the poker rules;

a non-event hold criterion is defined as the occurrence of a poker hand of at least a predetermined hold value lower than said credit value according to the poker rules; and a no-credit criterion is defined as any poker band failing to match said credit and said hold criterion.

16. The method of claim 14, wherein:

said principal game is a poker game;

a credit criteria is defined as the occurrence of a poker hand bearing at least one card from a predetermined first set of cards;

a hold criteria is defined as regarding the occurrence of a poker hand bearing no cards from said first set and bearing at least one card from a predetermined second set of cards; and a no-credit criteria is defined as any poker hand failing to match said credit and said hold criteria.

17. The method of claim 14, wherein said step of signaling comprises evaluating said number of credits independently from an order or a sequence thereof.

18. The method of claim 14, wherein said step of signaling comprises evaluating said number of credits according to an order or a sequence thereof.

19. The method of claim 14, wherein a bet is required for the completion of said step of monitoring events in said auxiliary game.

20. The method of claim 14, wherein said number of past events is at least six (6).

21. The method of claim 14, further comprising the step of displaying information regarding credits obtained in said number of past events.

22. The method of claim 21, wherein said step of displaying information further comprises the step of displaying information regarding prizes awarded.

23. The method of claim 20, wherein said step of displaying information is accomplished by:

displaying a matrix display; and filling up a row or a column of said matrix display each time a new said event occurs in said principal game with symbols corresponding to a credit event or a no-credit event.

24. The method of claim 23, wherein the number of cells filled up with either credit or no credit symbols after the occurrence of an event is determined according to bet level on said principal game.

25. The method of claim 23, wherein each said row or said column is used to monitor a different number of said credit symbols, and each said row or said column is associated to a prize.

26. The method of claim 23, wherein said step of signaling comprises evaluating at least two (2) but not all of the cells of said matrix according to a predetermined pattern based on each said evaluated cell bearing either a credit or a no-credit symbol.

27. The method of claim 23, wherein said step of filling up said matrix is accomplished by:

erasing said symbols corresponding to oldest said events; and displaying new symbols in said matrix according to new event to keep a constant number of said events monitored in said auxiliary game.

28. The method of claim 27, wherein said step of filling up said matrix further comprises erasing or replacing credit symbols participating in the awarding of an auxiliary prize.

29. The method of claim 28, wherein said matrix monitors at least three (3) said auxiliary prizes.

30. A gaming apparatus including an auxiliary component, the apparatus comprising:

a principal game controller generating a signal representing principal game outcomes in a principal game;

a class determination means for interpreting a principal game outcome and generating a class signal, said class signal corresponding to either a credit event, a non-credit event, or a non-event hold;

a monitoring means for keeping track of credit events and no-credit events over a predetermined number of past events;

a payoff means for awarding a prize when a predetermined number of credits are monitored within said predetermined number of past events; and a display.

* * * * *